US007793443B2

(12) United States Patent
Galbreath

(10) Patent No.: US 7,793,443 B2
(45) Date of Patent: Sep. 14, 2010

(54) SOIL FRACTURING TOOL

(76) Inventor: Guy Randall Galbreath, 6306 99 Street, Grande Prairie, AB (CA) T8W 2K6

( * ) Notice: Subject to any disclaimer, the term of this patent is extended or adjusted under 35 U.S.C. 154(b) by 0 days.

(21) Appl. No.: 12/366,180

(22) Filed: Feb. 5, 2009

(65) Prior Publication Data

US 2009/0199440 A1 Aug. 13, 2009

(30) Foreign Application Priority Data

Feb. 8, 2008 (CA) ..... 2621691

(51) Int. Cl.
*E02F 3/40* (2006.01)
*E02F 3/96* (2006.01)
*E02F 3/04* (2006.01)

(52) U.S. Cl. ..... 37/444; 37/408; 37/412; 37/903

(58) Field of Classification Search ..... 37/444, 37/412, 270, 408, 903
See application file for complete search history.

(56) References Cited

U.S. PATENT DOCUMENTS

| | | | | | |
|---|---|---|---|---|---|
| 834,030 | A | * | 10/1906 | Sutton | 172/132 |
| 2,856,707 | A | * | 10/1958 | Coder | 37/404 |
| 3,109,248 | A | * | 11/1963 | Vos | 37/408 |
| 3,200,520 | A | * | 8/1965 | Harvey | 37/431 |
| 3,349,934 | A | * | 10/1967 | Moyer et al. | 414/704 |
| 3,392,464 | A | | 7/1968 | MacDonald | |
| RE26,439 | E | * | 8/1968 | Long | 280/456.1 |
| 3,403,940 | A | * | 10/1968 | Clark | 299/26 |
| 3,471,950 | A | * | 10/1969 | Ferwerda | 37/403 |
| 3,596,996 | A | | 8/1971 | Carter | |
| 3,724,899 | A | * | 4/1973 | Clark | 299/26 |
| 3,778,111 | A | | 12/1973 | Ciofani | |
| 4,041,624 | A | | 8/1977 | Fryrear | |
| 4,221,434 | A | * | 9/1980 | Swisher et al. | 299/39.6 |
| 4,230,435 | A | * | 10/1980 | Azevedo | 414/722 |
| 4,279,085 | A | * | 7/1981 | Arnold | 37/444 |
| 4,921,392 | A | * | 5/1990 | Wagner | 414/695 |
| 4,962,597 | A | | 10/1990 | Kutra et al. | |

(Continued)

FOREIGN PATENT DOCUMENTS

| | | |
|---|---|---|
| CA | 1171274 | 7/1984 |

(Continued)

OTHER PUBLICATIONS

Frozen topsoil cutter pamphlet, Frozen Topsoil Cutting Ltd. Online: (www.sharp-environmental.com/docs/ftc_flyer.pdf) available at least as early as Jan. 1, 2008.

*Primary Examiner*—Thomas B Will
*Assistant Examiner*—Abigail A Risic
(74) *Attorney, Agent, or Firm*—Davis & Bujold, P.L.L.C.

(57) ABSTRACT

A soil fracturing tool includes an excavator bucket having a first side, a second side, and a bottom surface defining a soil receiving portion. The bottom surface has a leading edge toward a front of the excavator bucket. A first blade and a second blade extend downward from the bottom surface of the excavator bucket. The distance between the first blade and the second blade is substantially the same as the width of the excavator bucket. A cutting depth guide guides the depth of the first blade and the second blade. A digging depth guide guides the depth of the leading edge of the excavator bucket.

4 Claims, 5 Drawing Sheets

U.S. PATENT DOCUMENTS

| | | | | |
|---|---|---|---|---|
| 5,115,583 | A | 5/1992 | Vail | |
| 5,456,028 | A | 10/1995 | Larson | |
| 5,559,725 | A | 9/1996 | Nielson et al. | |
| 6,098,320 | A | 8/2000 | Wass | |
| 6,490,815 | B1 | 12/2002 | Pratt | |
| 6,546,650 | B1 * | 4/2003 | Meurer | 37/405 |
| 6,626,499 | B1 | 9/2003 | Schenk et al. | |
| 6,671,984 | B2 | 1/2004 | Larson | |
| 6,729,051 | B1 | 5/2004 | Hollen | |
| 6,817,121 | B2 | 11/2004 | Grgic | |
| 6,913,086 | B2 * | 7/2005 | Stevens | 172/815 |
| 6,990,758 | B1 | 1/2006 | Holmes et al. | |
| 7,059,072 | B2 | 6/2006 | Archuleta, Jr. et al. | |
| 7,086,184 | B2 | 8/2006 | Archuleta, Jr. et al. | |
| 7,454,850 | B2 * | 11/2008 | Smith | 37/417 |
| 7,506,462 | B2 * | 3/2009 | Reid | 37/409 |
| 2006/0070268 | A1 * | 4/2006 | Westendorf et al. | 37/444 |

FOREIGN PATENT DOCUMENTS

| | | |
|---|---|---|
| CA | 2293958 | 6/2001 |
| CA | 2515960 | 2/2004 |
| CA | 2557838 | 11/2007 |

* cited by examiner

SOIL FRACTURING TOOL

FIELD

The present patent document relates to a tool used to fracture soil to facilitate its removal.

BACKGROUND

Topsoil is commonly stripped for purposes such as conservation, pipeline right of ways, landscaping, utility industries, etc. Tools that have been developed to remove the topsoil include a grinding-type tool shaped like a drum which acts as a tiller to loosen the topsoil, and plough or cultivator-type tools which are pulled behind large tractors.

SUMMARY

There is provided a soil fracturing tool, including an excavator bucket having a first side, a second side, and a bottom surface defining a soil receiving portion. The bottom surface has a leading edge toward a front of the excavator bucket. A first blade and a second blade extend downward from the bottom surface of the excavator bucket. The distance between the first blade and the second blade is substantially the same as the width of the excavator bucket. A cutting depth guide guides the depth of the first blade and the second blade. A digging depth guide guides the depth of the leading edge of the excavator bucket.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
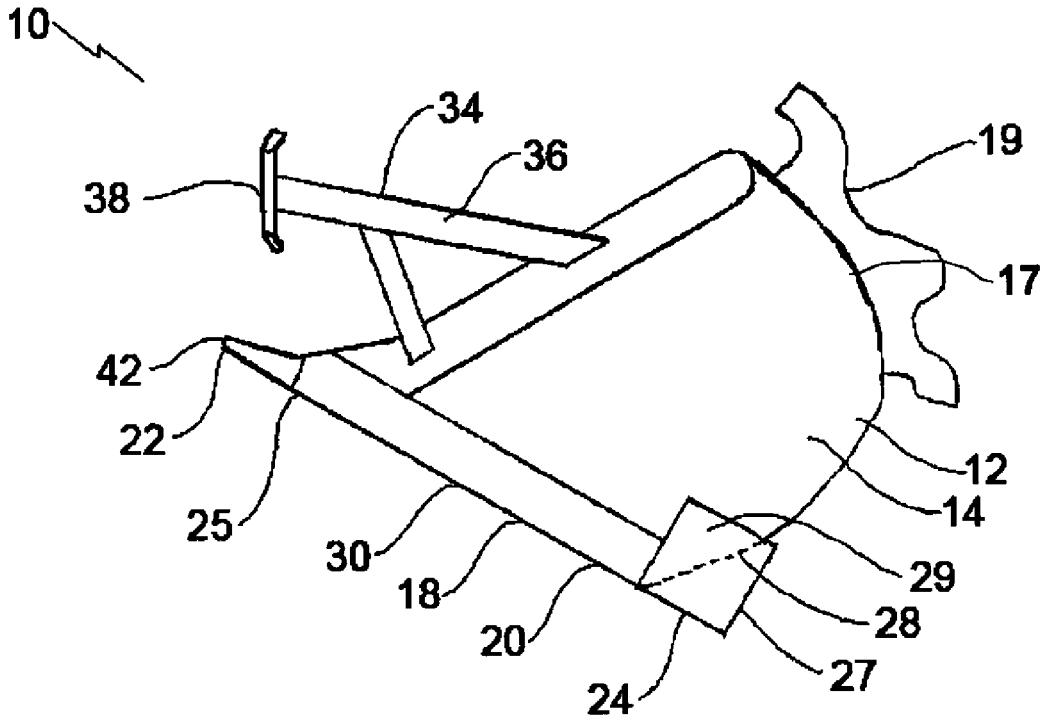
FIG. 1 is a side elevation view of a soil fracturing tool.

A soil fracturing tool generally identified by reference numeral 10, will now be described with reference to FIG. 1 through 4.

Figure 2:
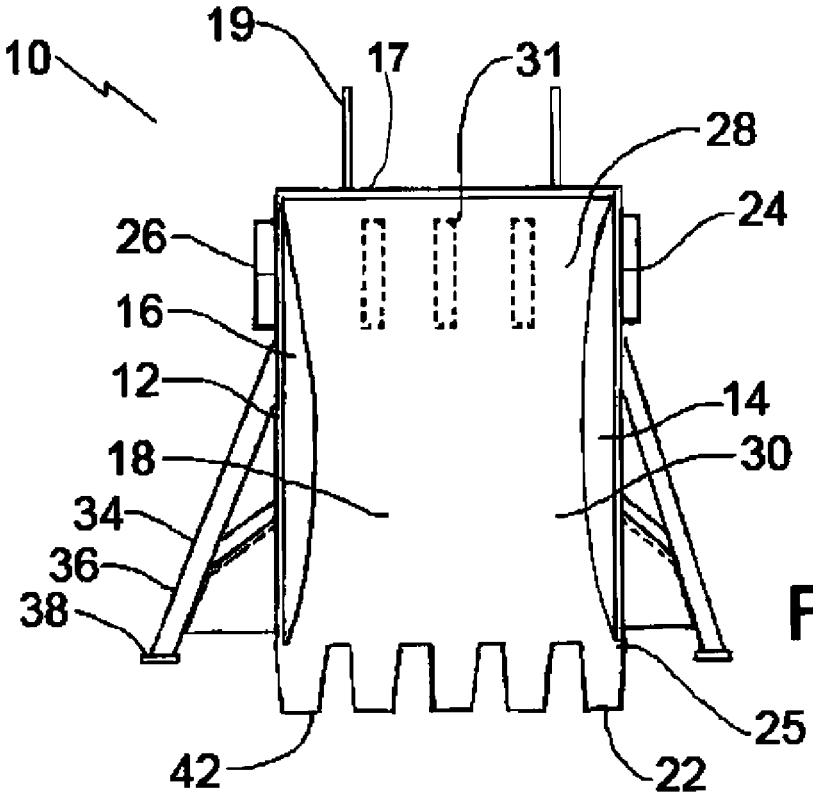
FIG. 2 is a front elevation view of the soil fracturing tool.

Structure and Relationship of Parts:

Referring to FIG. 2, soil fracturing tool 10 includes an excavator bucket 12 that has a first side 14, a second side 16, a fixed rear wall 17 and a bottom surface 18. Bucket 12 is provided with a common quick attach 19. Referring to FIG. 1, bottom surface 18 defines a soil receiving portion 20 and has a leading edge 22 toward a front 25 of the excavator bucket 12. It will be appreciated that bottom surface 18 and sides 14 and 16 may take various shapes and sizes, however, in a preferred embodiment, the excavator bucket is a standard bucket that is used.

Figure 3:
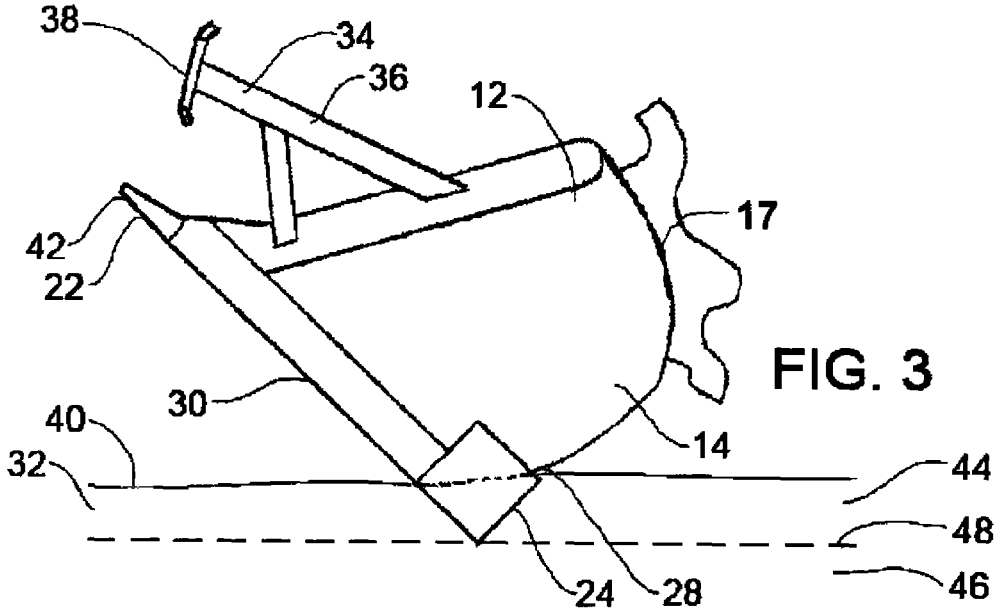
FIG. 3 is a side elevation view of the soil fracturing tool cutting soil.

Referring to FIG. 2, a first blade 24 and a second blade 26 extend away from fixed rear wall 17 of excavator bucket 12. As shown, first and second blades 24 and 26 are attached to first and second sides 14 and 16, respectively, such that the distance between first and second blades 24 and 26 is substantially the same as the width of excavator bucket 12. First and second blades 24 and 26 are attached to sides 14 and 16 at the curved portion 28 of bottom surface 18, such that they do not extend below the flat portion 30 of bottom surface 18. This position for blades 24 and 26 is selected to reduce their interference with the digging operation of bucket 12. The curved portion 28 thus acts as a cutting depth guide such that, as blades 24 and 26 are inserted into the ground 32 as shown in FIG. 3, the depth of blades 24 and 26 is controlled. Blades 24 and 26 are shown as having a diamond shape. The ground piercing edges of the diamond are preferably bevelled to improve the cutting ability of blades 24 and 26. The triangular shape of the ground piercing portion 27 is convenient as it provides structural strength when being inserted into ground 32 and also while being pulled forward to cut ground 32. However, other shapes and designs may also be used. In one example, a straight or curved bar, may be used. It will also be understood that the mounting portion 29 may also be selected to suit the needs of a particular situation. For example, mounting portion 29 may be designed to allow blades 24 and 26 to be adjustable. Other designs to make the cutting depth of blades 24 and 26 are also possible. Furthermore, referring to FIG. 2, optional intermediate blades 31 may also be included, depending on the desired consistency of ground 32 after excavation.

Figure 4:
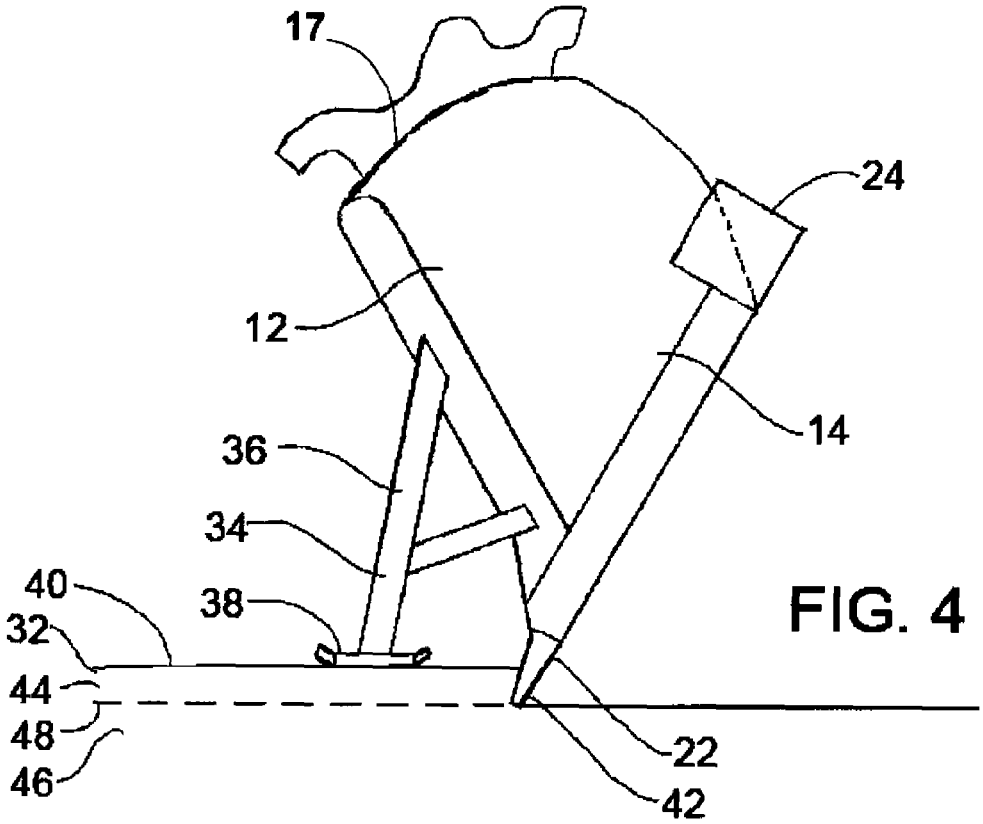
FIG. 4 is a side elevation view of the soil fracturing tool removing soil.

Referring to FIG. 1, there is also a digging depth guide 34 for limiting the depth of leading edge 22 of excavator bucket 12. Referring to FIG. 2, as depicted, digging depth guide 34 is an appendage 36 attached to each side 14 and 16 of excavator bucket 12 that terminates in a plate 138. Referring to FIG. 4, leading edge 22 may then be inserted into ground 32 until plate 38 contacts the upper surface 40 of ground 32 to reach the desired depth. As can be seen, plate 38 is positioned in front of leading edge 22 such that it will not interfere with, or be interfered with by, leading edge 22. The angle that appendage 36 extends from sides 14 and 16 of bucket 12 is selected to provide a suitable angle of entry for leading edge 22. Optimization of this angle may be determined by experimentation and may depend on the conditions of its use. Digging depth guide 34 may take other forms, and may be adjustable. This may be done by either providing a telescopic arm for appendage 36, by providing an adjustable mounting, etc. and will depend on the final design of digging depth guide. Leading edge 22 is shown to have teeth 42. Leading edge 22 may also be modified to include a blade positioned in front of and between teeth 42 to provide a smoother and cleaner separation of soil layers.

When used to strip topsoil away from the subsoil, it is preferable to have cutting depth guide permit blades 24 and 26 to be inserted into ground 32 to substantially the same depth as digging depth guide permits leading edge 22.

Operation:

The operation of soil fracturing tool 10 as described above will now be discussed with reference to FIGS. 3 and 4. The method described below is particularly useful for stripping a layer of frozen topsoil 44 from a layer of subsoil 46, such as clay. Topsoil 44 has a certain strength, and an ability to resist a stripping operation. However, topsoil 44 also has a natural separation point at the interface 48 between topsoil 44 and subsoil 46.

Referring to FIG. 3, bucket 12 is first curled such that blades 24 and 26 extend downward from the bottom of bucket 12. Blades 24 and 26 are then inserted until cutting depth guide 28 engages upper surface 40 of ground 32. This depth is selected such that blades 24 and 26 reach approximately to interface 48 between topsoil 44 and subsoil 46. Bucket 12 is then pulled forward to cut layer of topsoil 44. Once topsoil 44 has been cut, the tension is relieved, and the ability to resist the stripping operation is reduced or removed. Referring to FIG. 4, bucket 12 is then repositioned where blades 24 and 26 were inserted with leading edge 22 extending downward as shown. Leading edge 22 is then inserted into topsoil 44 until plate 38 of digging depth guide 34 engages upper surface 40 of ground 32. As with cutting depth guide 28, the depth permitted by digging depth guide 34 is selected such that leading edge 22 reach approximately to interface 48. Bucket 12 is then pulled forward in order to strip topsoil 44 from subsoil 46.

Variations:

In keeping with best mode requirements, there will now be described a variation of soil fracturing tool 10, with reference to FIG. 5 through 10. This variation of soil fracturing tool, generally referenced by numeral 100, reflect improvements made as a result of knowledge gained from experience in field use.

Figure 5:
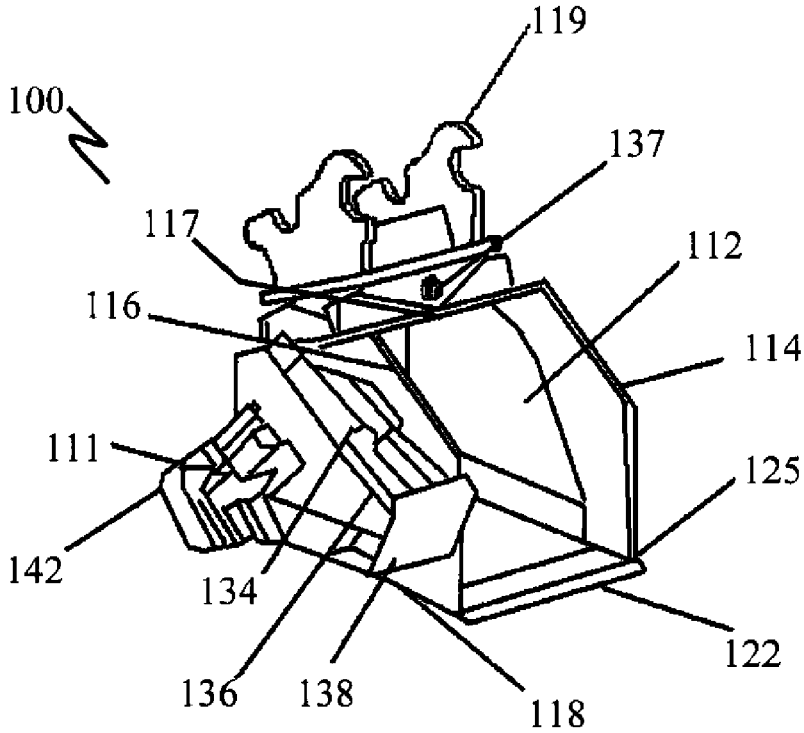
FIG. 5 is a perspective view of a variation of soil fracturing tool.
Figure 6:
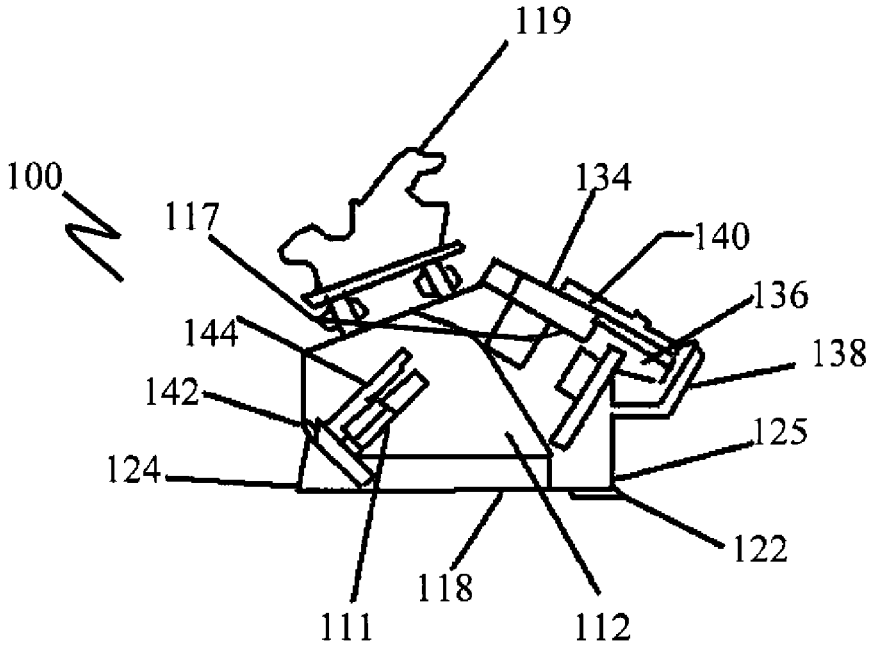
FIG. 6 is a side elevation view of the soil fracturing tool illustrated in FIG. 5.

Referring to FIG. 5, soil fracturing tool 100 includes an excavator bucket 112 that has a first side 114, a second side 116, a fixed rear wall 117 and a bottom surface 118. Bucket 112 is provided with a common quick attach 119. Referring to FIG. 6, bottom surface 118 has a leading edge 122 toward a front 125 of the excavator bucket 112. As will be understood, bucket 112 may have a cutting edge on leading edge 122 as shown FIG. 6, or teeth as shown in FIG. 2. Referring to FIGS. 5 and 6, it will be appreciated that bottom surface 118 and sides 114 and 116 may take various shapes and sizes, however, with soil fracturing tool 100, excavator bucket 112 it is a standard bucket.

Figure 7:
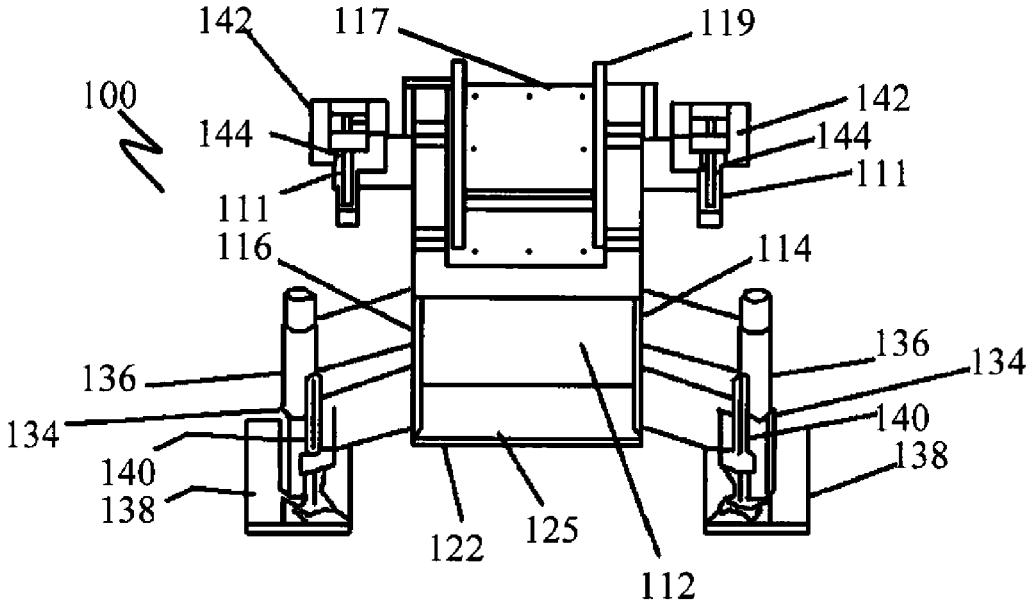
FIG. 7 is a top plan view of the soil fracturing tool illustrated in FIG. 5.

Referring to FIG. 7, there is a digging depth guide 134 for limiting the depth of leading edge 122 of excavator bucket 112. As shown, digging depth guide 134 is a front appendage 136 attached to each side 114 and 116 of excavator bucket 112 that terminates in a plate 138. A dog clutch assembly 140 is provided for adjusting the length of telescopic digging depth guide 134. Dog clutch assembly 140 is one area in which soil fracturing tool 100 has been improved. It was found that considerable strain was placed upon digging depth guide 134 and failures occurred. A dog clutch assembly in which teeth are intermeshed has proven to be a much more robust form of engagement.

Figure 8:
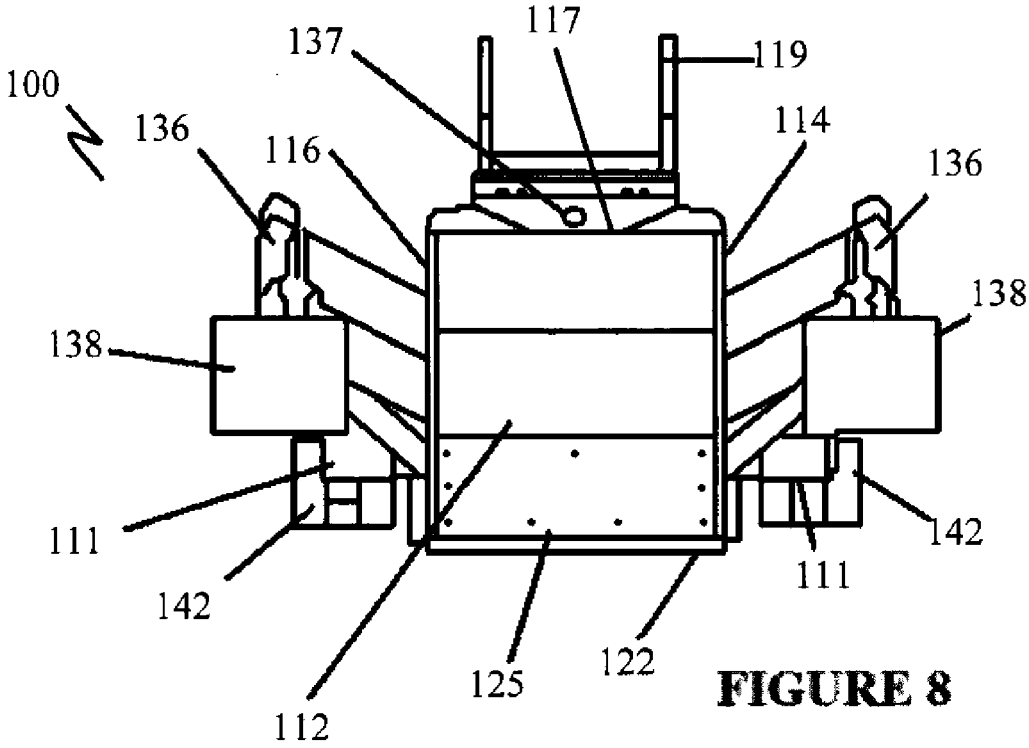
FIG. 8 is a front view of the soil fracturing tool illustrated in FIG. 5.

Front appendages 136 are independently adjustable such that each can be adjusted to different lengths. Soil fracturing tool 100 is permitted to rock laterally about pin 137 as shown in FIG. 8. In addition, by adjusting each of front appendages 136, it is also possible to reduce the strain on one appendage 136 or the other. Furthermore, front appendages 136 can be independently adjusted to suit the uneven contours of an underlying ground surface.

Referring to FIG. 8, in variation 100, front appendages 136 also have broader stance than that depicted in embodiment 10 illustrated in FIG. 1. Broader stance provides for greater stability. Front appendages also have a greater range of adjustment in depth. An example of a sample range of adjustment is between 8 and 14 inches, although other ranges are possible depending on the breadth of stance used. The broader stance is believed to confine soil more.

Figure 9:
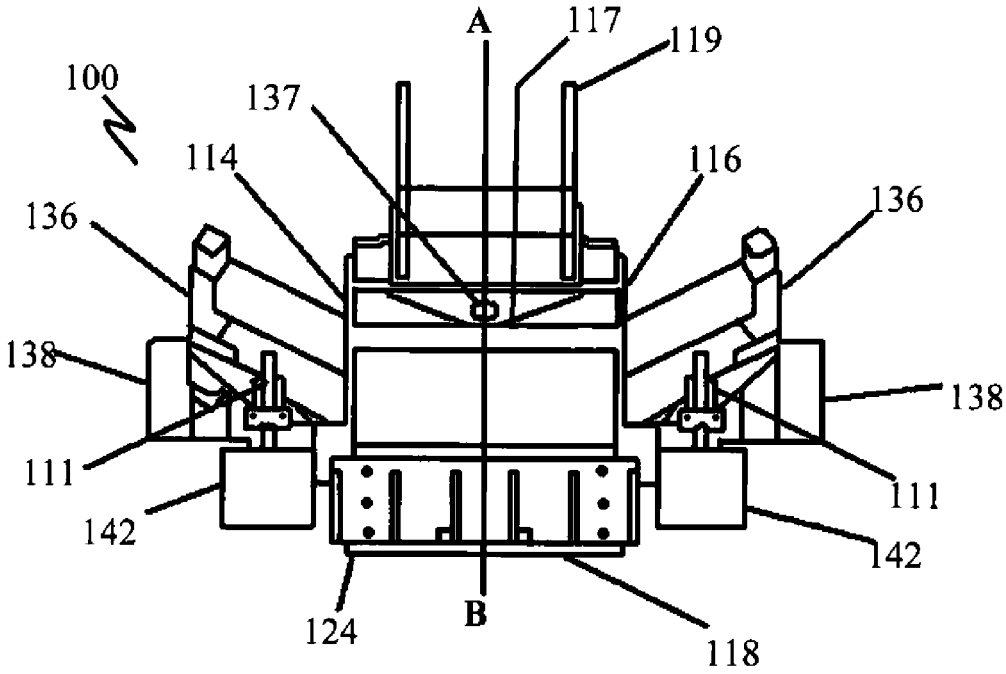
FIG. 9 is a rear view of the soil fracturing tool illustrated in FIG. 5.
Figure 10:
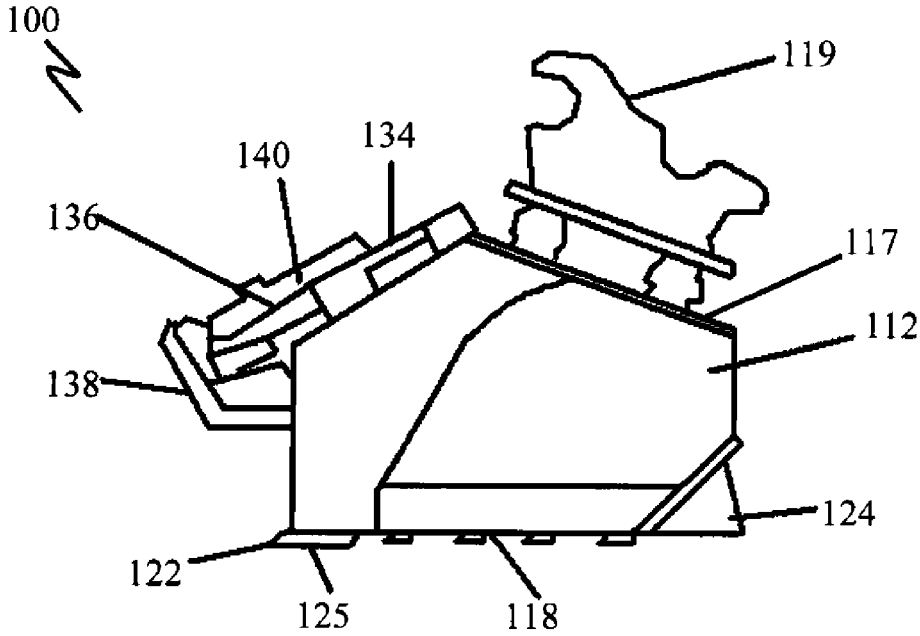
FIG. 10 is a side elevation view in section of the soil fracturing tool taken along lines A-B as shown in FIG. 9.

Unlike embodiment 10, soil fracturing tool 100 provides telescopically adjustable back appendages 111 as well, which also terminate in plates 142. A dog clutch assembly 144 is provided for adjusting the length of back appendages 111. Referring to FIG. 7, back appendages 111 can be adjusted to control the depth of blades 124 when cutting into top soil. Referring to FIG. 9, the ability to adjust the depth allows blades 124 to better relieve soil tension and improve the ability of cutting edge. Just as with front appendages 136 illustrated in FIG. 10, back appendages 111 illustrated in FIG. 7, are independently adjustable so as to be adjusted to suit the ground contour of an underlying surface and reduce strain. Soil fracturing tool 100 illustrated in FIG. 5 through 10 operates in substantially the same manner as embodiment 10 illustrated in FIG. 1 through 4 as described above.

In summary, the improvements in this version include:

Appendages for depth adjustment at the front have been made more robust and with a broader stance;

Appendages for depth adjustment have been added at the rear;

The adjustment mechanism used has been changed to a dog clutch engagement.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A soil fracturing tool comprising:

an excavator bucket having a fixed first side, a fixed second side, a fixed rear wall, and a fixed bottom surface defining a soil receiving portion, the bottom surface having a fixed leading edge toward a front of the excavator bucket;

a fixed first blade and a fixed second blade extending away from the fixed rear wall, a distance between the first blade and the second blade being substantially the same as a width of the excavator bucket;

a cutting depth guide for guiding a depth of the first blade and the second blade, the cutting depth guide being adjustable, and the cutting depth guide comprising two ground engaging adjustable depth outrigger appendages extending from the first side and the second side of the excavator bucket near the first blade and the second blade; and a digging depth guide for guiding the depth of the leading edge of the excavator bucket, the digging depth guide comprising two ground engaging adjustable depth outrigger appendages that extend from the first side and the second side toward the front of the excavator bucket.

2. The top soil fracturing tool of claim 1, comprising one or more intermediate blades positioned between the first blade and the second blade.

3. A method of fracturing soil, the method comprising the steps of:

providing an excavator bucket comprising:

a fixed first side, a fixed second side, a fixed rear wall and a fixed bottom surface defining a soil receiving portion, and the bottom surface having a fixed leading edge toward a front of the excavator bucket;

a fixed first blade and a fixed second blade extending away from the fixed rear wall, a distance between the first blade and the second blade being substantially the same as a width of the excavator bucket;

a cutting depth guide for guiding a depth of the first blade and the second blade, the cutting depth guide being adjustable, the cutting depth guide comprising two around engaging adjustable depth outrigger appendages that extend from the first side and the second side of the excavator bucket near the first blade and the second blade; and a digging depth guide for guiding the depth of the leading edge of the excavator bucket, the digging depth guide comprising two ground engaging adjustable depth outrigger appendages that extend from the first side and the second side toward the front of the excavator bucket;

cutting the soil by positioning the excavator bucket with the leading edge raised and the first blade and the second blade oriented downward, lowering the first blade and the second blade into the soil to a first predetermined depth as determined by the cutting depth guide and moving the excavator bucket to pull the first blade and the second blade through the soil;

positioning the excavator bucket with the first blade and the second blade raised and the leading edge oriented downward;

inserting the leading edge of the excavator bucket into the soil down to a second predetermined depth as determined by the digging depth guide; and removing the soil using the excavator bucket.

4. The method of claim 3, wherein the first predetermined depth and the second predetermined depth are the same and correspond to an interface between a topsoil layer and a subsoil layer.

* * * * *